US005979701A

United States Patent [19]

Wenzel et al.

[11] Patent Number: 5,979,701

[45] Date of Patent: Nov. 9, 1999

[54] PAGE BRAKE IN A PRINTING MACHINE FLY

[75] Inventors: Jurgen Wenzel, Hainburg; Peter Mayer, Muhlheim; Georg Hartung, Seligenstadt, all of Germany

[73] Assignee: MAN Roland Druckmaschinen AG, Offenbach/Main, Germany

[21] Appl. No.: 08/945,252

[22] PCT Filed: Apr. 24, 1996

[86] PCT No.: PCT/DE96/00714

§ 371 Date: Oct. 23, 1997

§ 102(e) Date: Oct. 23, 1997

[87] PCT Pub. No.: WO96/34820

PCT Pub. Date: Nov. 7, 1996

[30] Foreign Application Priority Data

May 3, 1995 [DE] Germany ..... 195 15 725
Apr. 12, 1996 [DE] Germany ..... 196 14 491

[51] Int. Cl.[6] ..... B65H 29/68; B65H 29/04; B65H 29/10

[52] U.S. Cl. ..... 221/183; 271/85; 271/204

[58] Field of Search ..... 271/85, 182, 183, 271/203, 204, 205, 206, 202

[56] References Cited

U.S. PATENT DOCUMENTS

| | | | |
|---|---|---|---|
| 2,106,199 | 1/1938 | Wormser . | |
| 2,752,831 | 7/1956 | Pierce | 93/92 |
| 3,933,351 | 1/1976 | Mayer et al. . | |
| 4,173,301 | 11/1979 | Turini et al. . | |
| 4,469,321 | 9/1984 | Geschwindner . | |

FOREIGN PATENT DOCUMENTS

| | | | |
|---|---|---|---|
| 2720674 | 11/1978 | Germany | 271/182 |
| GM 80 03 052 | 8/1980 | Germany . | |
| 29 08 901 | 9/1980 | Germany . | |
| 3419313 | 1/1985 | Germany | 271/183 |
| 37 36787 A1 | 10/1988 | Germany . | |
| 003939212 | 6/1990 | Germany | 271/182 |
| 611 579 | 6/1979 | Switzerland . | |
| 0716952 | 2/1980 | U.S.S.R. | 271/183 |
| 0956398 | 9/1982 | U.S.S.R. | 271/183 |

*Primary Examiner*—William E. Terrell
*Assistant Examiner*—Kenneth W Bower
*Attorney, Agent, or Firm*—Graham & James LLP

[57] ABSTRACT

A sheet brake improves laying sheets off onto a stack in the take-off unit of a sheet-fed rotary printing press. The sheet brake is provided with a crank drive that generates a back-and-forth stroke by way of a synchronized drive mechanism at the rate traveled by the sheets. The rear portion of each sheet is forced by suction against a suction strip provided on the brake so that the sheet is braked while being stretched and then lowered onto the top of the stack. The suction strip has a groove arranged such that the sheet is braked and stretched as the suction strip works in conjunction with an operation of a take over gripper to accurately guide the sheet to the stack.

19 Claims, 8 Drawing Sheets

15
13
11
10
9
8
5
7
6
12

PAGE BRAKE IN A PRINTING MACHINE FLY

BACKGROUND OF THE INVENTION

1. Field of Invention

The present invention relates to a sheet brake for use in a printing press, and more specifically, to a sheet brake for a printing press for seizing a bottom portion of a printed sheet and guiding the sheet to a stack while stretching and decelerating the sheet.

2. Description of the Related Art

In a conventional printing presses, sheets are transported through a sheet-fed rotary printing press from a sheet feeder, through the printing cylinders, and, by way of a chain conveyor system to a sheet take-off device, which lays printed sheets off onto a stack. The printed sheets must be decelerated from a maximum speed to zero speed at a location of the sheet take-off device. The floating sheets must simultaneously be lowered onto the top of the stack of printed sheets.

There are problems not only in decelerating the sheets but also in that the sheets descend in a direction which is perpendicular to a major plane of each sheet and, as a result, the descending travel of the sheets is impeded by air resistance. This causes problems in laying off sheets at high speeds due to the oncoming sheet coming into contact with the rear edge of the sheet which has just been laid off.

Solutions to such problems in the form of blowers located above the stack have been used to force the laid-off sheet in a downward direction. The sheets, however, are powerfully affected by the streams of air and air resistance as described above. Precise sheet guidance is very difficult at high speeds, especially at the rear edge of the sheet. This is especially true when the rear corners of the sheet are forced upwardly by the streams of air coming from the cushion of air present below the sheet.

A sheet take-off apparatus for a rotary press is described in German OS 2 720 674. The sheet take-off apparatus has a sheet brake in the form of a box with several slots at the top on the printing press take-off device located near the rear edge of the stack of sheets. The box is adapted to blow air escaping through a first part of the box from slots arranged to direct air against the direction in which the sheets travel. Due to aerodynamic principles, lower-pressure currents are generated toward the box by other slots located at the top of the box. The resulting vacuum or suction allows a sheet which is secured by the conveyor gripper system and traveling past the top of the box to be captured via suction and held with a certain level of force. As the sheet travels on, the sheet skids over the box and, once released by the gripper system, is braked or decelerated by the force. The sheet can subsequently be guided at rest against stops in the vicinity of the take-off stack. For this purpose, the path traveled by the sheets or conveyor must slope down above the stack in the vicinity of the take-off device and in the direction of travel.

This is a major drawback because the above-described arrangement severely restricts the space available for the intervention of a possibly necessary sample-sheet extractor. To improve the downward motion of the taken-off sheet traveling from the conveyor to the top of the stack, the box or brake is provided with a stroke extending across the direction of travel. The sheet being laid off and secured by the gripper system is accordingly guided out of the direction of travel and drawn down to approximately the level of the top of the stack by aligning stops, where the sheet can be laid off.

This device has other drawbacks. Large and accordingly heavy sheets in particular cannot be braked or decelerated as desired, which is why the device has the extra, separately driven aligning stops at the rear edge of the stack to ensure that the sheets will directly encounter the stops at the forward edge of the sheet. Due to the blowing and suction action that occurs at the brake, the sheets must be held by the gripper until almost the last second to allow the sheets to be guided down accurately enough against the forward-edge stops. The downward-sloping sheet guidance is also a drawback. Otherwise, the above-described brake is also similar to what is called a sheet catcher. Sheet catchers are generally used to guide a sheet along its path and force the sheet into a prescribed direction, and the braking action is intended only to smooth the sheet along its path and not really intended to brake or decelerate the sheet, due to the priority of its guidance action.

Another sheet take-off device is described in DE-GM 80 03 052. It includes a sheet brake in the form of a combination suction cylinder and blowing-sucking device accommodated in a take-off device located upstream of the rear edge of a stack in the direction of travel and raised and lowered between a capture position and a lay-off position. Since the blowing-sucking device is rigidly fastened to the suction cylinder, the blowing-sucking device executes the rising and falling strokes together. The blowing-sucking device is intended to capture the sheets and feed them to the suction cylinder. This device has several is drawbacks related to how it handles the sheets being laid off. First, since the sheets are guided along the edges of the cylinder only at certain points, smooth and flat as possible contact cannot always be ensured in the case of large sheets. Again, the blowing-sucking device blows a current of air below the oncoming sheets, disturbing the sheet flow and preventing reliable capture of the sheets, especially large-format printed stock. The same approach also impedes flat take-off.

"Take-overs" are known as another means of facilitating the take-off of large sheets in particular. Take-overs accept the delivered sheets from the conveyor gripper system, decelerate the sheets, and guide the sheets against the forward-edge stops. The take-overs act only against certain points on the sheet, which can cause buckling and irregular braking. Furthermore, the sheets are exposed at high speeds to powerful deceleration within an unstable plane of orientation.

SUMMARY OF THE INVENTION

The preferred embodiments of the present invention overcome the problems described above by providing a sheet brake for a printing press for handling taken-off sheets such that the sheets can be laid off reliably and with high precision, whereby a flat position of the sheet can also be positively affected during a sheet take-off operation.

The advantages described in the previous paragraph are achieved in accordance with the preferred embodiments of the present invention in which a sheet is guided, stretched, and lowered at its rear edge in two steps. In addition, according to the preferred embodiments of the present invention, without creating any drawbacks, a sheet is secured at its forward edge by take-over grippers and at its rear edge by the sheet brake for more accurate and reliable sheet guiding and braking.

According to a preferred embodiment of the present invention, a sheet brake is specifically designed to hold a sheet tight and extended laterally, such that the sheet can be reliably laid onto the stack in a stretched state during an optimally adjusted deceleration. The sheet will accordingly execute almost a single-point landing on the stack since the sheet will be laid off subject to substantially uniform guidance.

The sheet brake according to the preferred embodiments of the present invention is designed such that even in the event of different size sheets, seizure and lay-off of the sheets will always be synchronized with the sheet-feed rate. The drive mechanism is accordingly designed to be self-synchronizing during adjustment.

These and other elements, features, and advantages of the preferred embodiments of the present invention will be apparent from the following detailed description of the preferred embodiments of the present invention, as illustrated in the accompanying drawings.

DETAILED DESCRIPTION OF PREFERRED EMBODIMENTS

Figure 1:
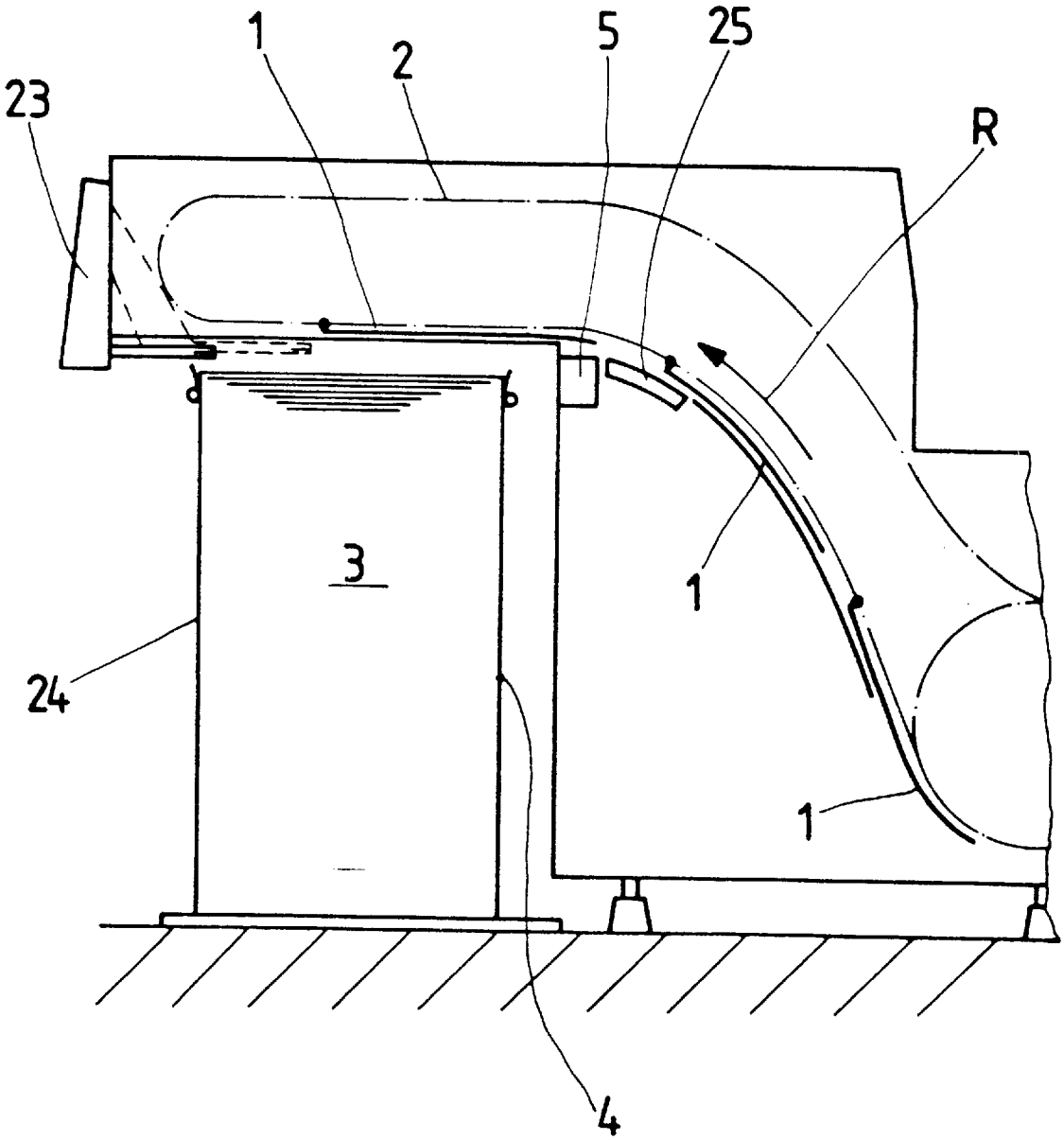
FIG. 1 illustrates a take-off device according to a preferred embodiment of the present invention.

FIG. 1 illustrates a take-off apparatus in a rotary press. A printed sheet 1 is guided along a gripper system in a chain-conveyor system 2 to a take-off stack 3. There is a sheet brake 5 located in the vicinity of the rear edge 4 of stack 3. Upstream of brake 5 in the direction R along a path traveled by the sheet, a sheet-capture device 25 is accommodated in the curve of chain-conveyor system 2. Brake 5 is intended to brake sheet 1 prior to lay-off of the sheet onto stack 3, so as to decelerate the sheet from a high conveyance speed to a lower take-off speed. Also in the vicinity of the forward edge 24 of the take-off apparatus is a take-over gripper 23 that accepts sheet 1 from chain-conveyor system 2 and guides it to stops located at edge 24.

Figure 2:
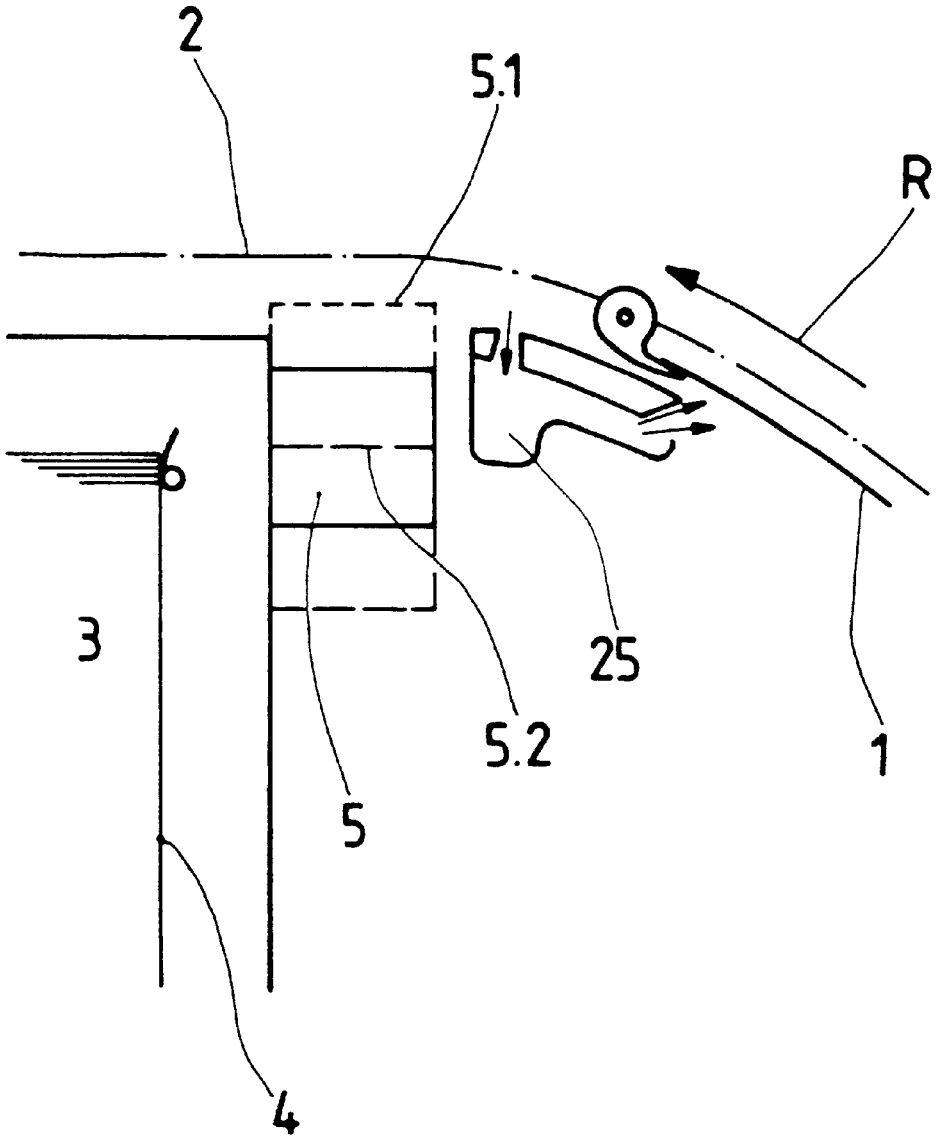
FIG. 2 is a section through the vicinity of the rear edge of the stack shown in FIG. 1.

FIG. 2 is a larger-scale detail of the rear edge 4 of stack 3. FIG. 2 shows the position of brake 5 in relation to a chain-conveyor system 2 conveying a sheet 1. Sheet-capture device 25 is positioned upstream of brake 5 in the direction R. Sheet capture device 25 is illustrated in detail only in operating principle. Sheet capture device 25 preferably includes a suction-generating device that operates on the blowing-suction principle to hold sheet 1 in a path which is arranged to be parallel chain-conveyor system 2. For this purpose, air blowing nozzles are aimed at an angle against direction R to generate a cushion of air below sheet 1. At the top of sheet-capture device 25 are additional openings subjected to lower pressure (indicated by the arrows) in accordance with the passing current of blown air. A resulting vacuum applied to sheet brake 5 is represented in one position by a continuous line and in two positions 5.1 and 5.2 by discontinuous lines, representing its up-and-down motion. Position 5.1 is the sheet take-over position and position 5.2 is the lay-off position.

Figure 3:
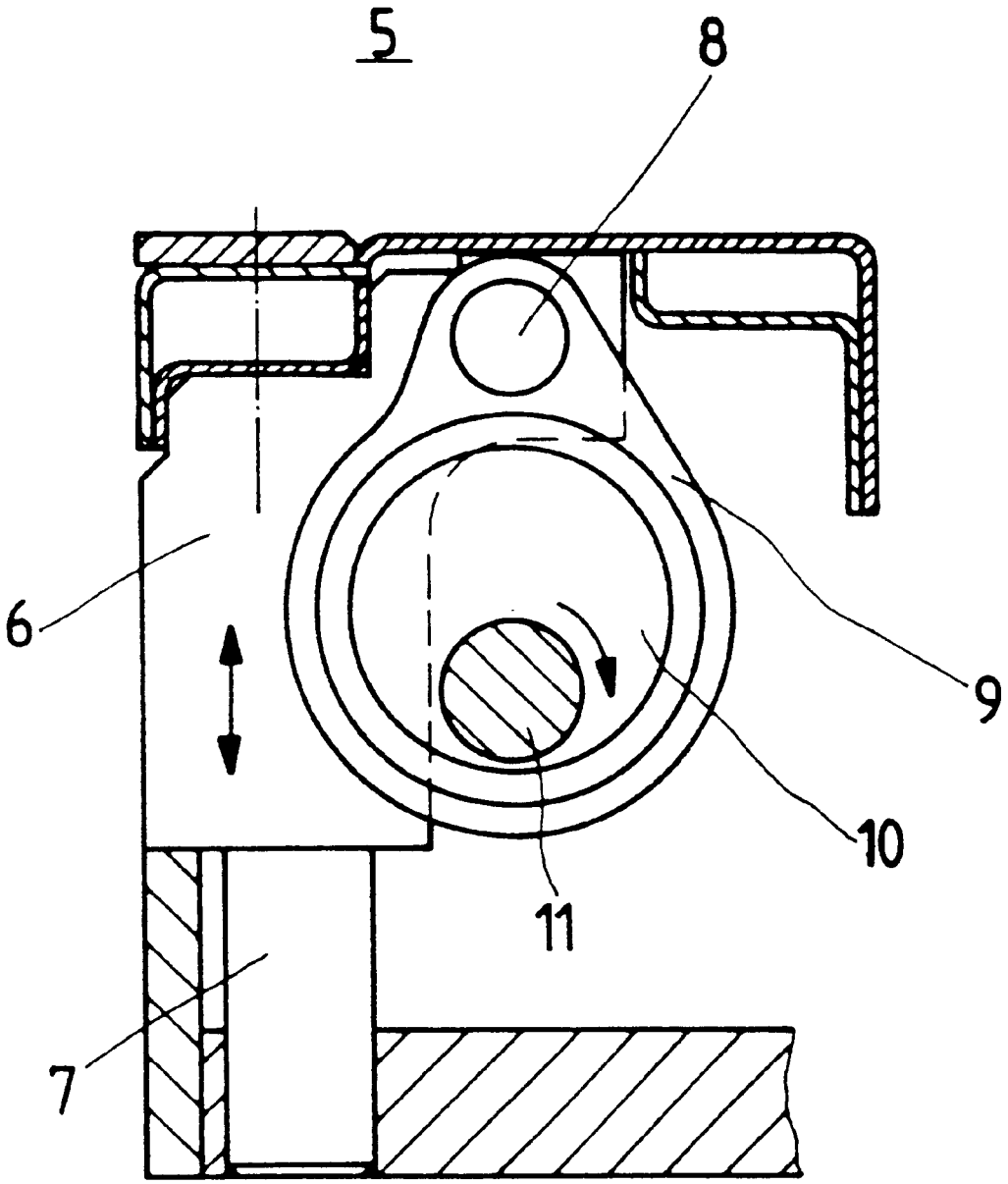
FIG. 3 is a cross section through the sheet brake of FIG. 1 and its associated drive mechanism.

FIG. 3 is a transverse section through the whole brake 5 system. It shows in detail how brake 5 is brought into one of its stationary positions 5.1, 5.2 extending at least twice over its width. Brake 5 is mounted on a holder 6 that moves along a vertical guidance bolt 7 fastened to the printing press. Secured to holder 6 is a drive bolt 8. Drive bolt 8 is engaged by a crank 9. Crank 9 rotates on a cam 10 mounted on a shaft 11. As the shaft 11 turns, the cam 10 will move brake 5 up and down on guidance bolt or bolts 7. The motion is accordingly linear and sinusoidal in terms of the motion of a traveling sheet 1.

Figure 4:
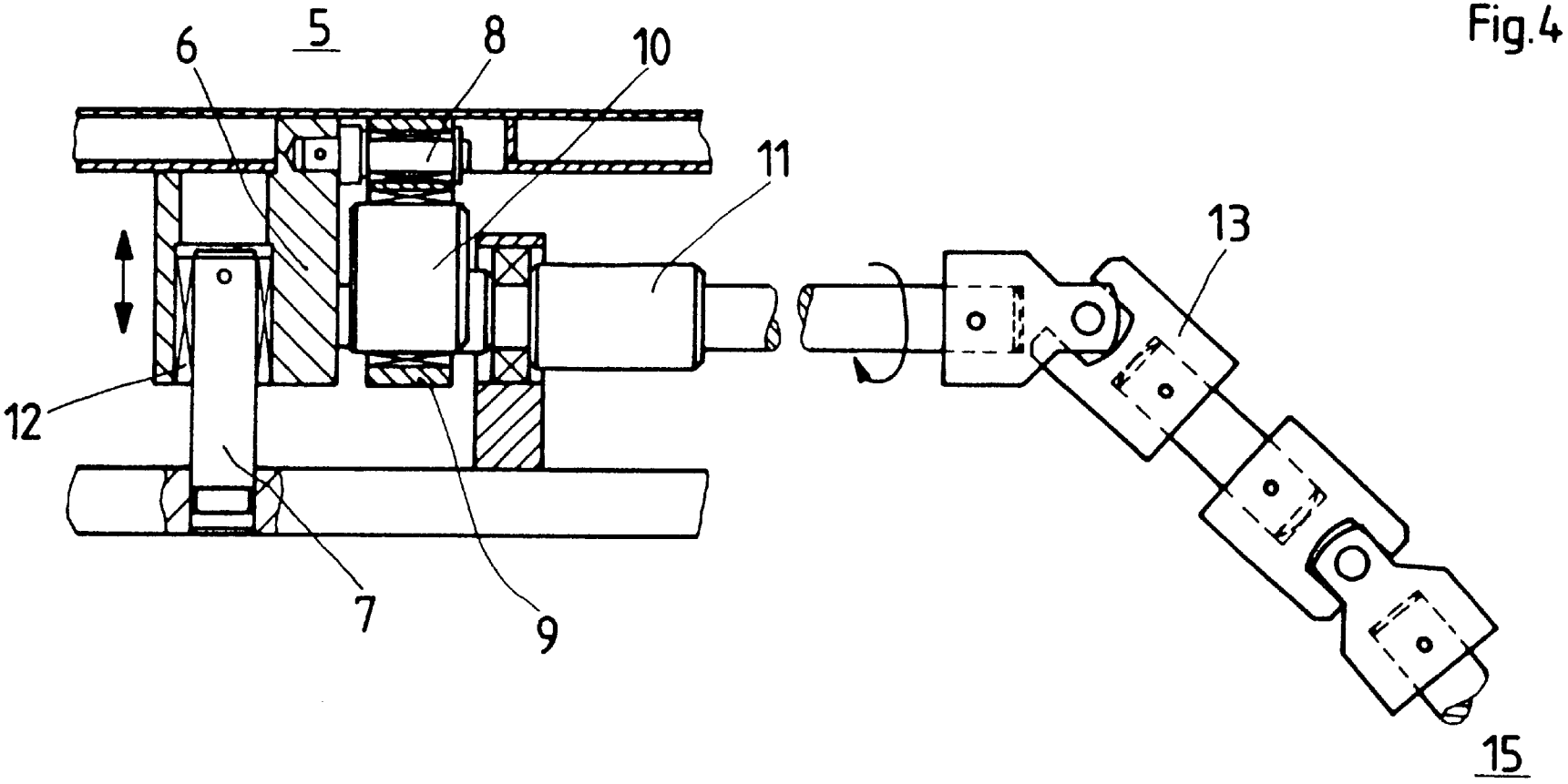
FIG. 4 is a longitudinal section through the brake drive mechanism of FIG. 1.

FIG. 4 is a transverse section through the drive mechanism, with part of the brake 5 mounted on its holder 6. Holder 6 is secured on guidance bolt 7 in a longitudinal guide 12 and connected to drive bolt 8. Crank 9 connects cam 10 or shaft 11 to drive bolt 8. Shaft 11 is driven by the drive mechanism 15 of the press by way of an articulated shaft 13, rotating at a speed corresponding to that of the traveling sheet 1.

Figure 5:
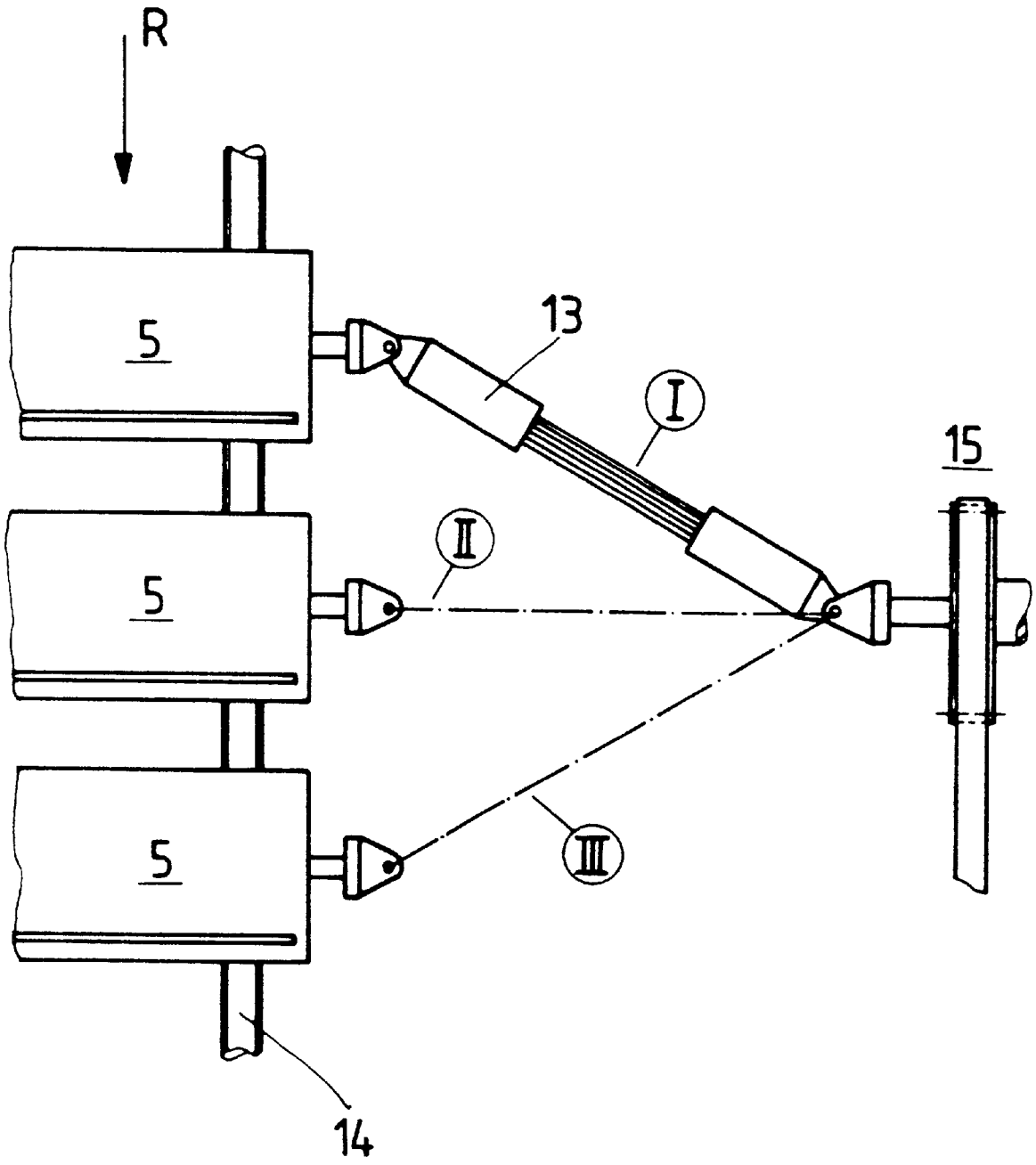
FIG. 5 is a schematic drawing showing how the brake of FIG. 1 is adjusted to accommodate sheets of different size.

FIG. 5 illustrates how brake 5 is adjusted for sheets of different size. The brake is positioned on one or more setting spindles 14 along direction R. Each spindle 14 is remote controlled. Articulated shaft 13 is also connected to a telescoping guide that allows it to adjust automatically to various lengths as brake 5 is displaced. Articulated shaft 13 can accordingly change its length between positions I-III without changing its rotation relative to drive mechanism 15 and the stroke-generating mechanism in brake 5. Position I is a position for handling the largest sheets and position III a position for handling the smallest sheets. These positions are preferably entered automatically to adjust for the particular sheet size. Brake 5 can also be adjusted in relation to the rear edge 4 of stack 3 by spindles 14 in order to optimize the lay-off relationship while the press is operating. Articulated shaft 13 is synchronized with the press by drive mechanism 15.

Figure 6:
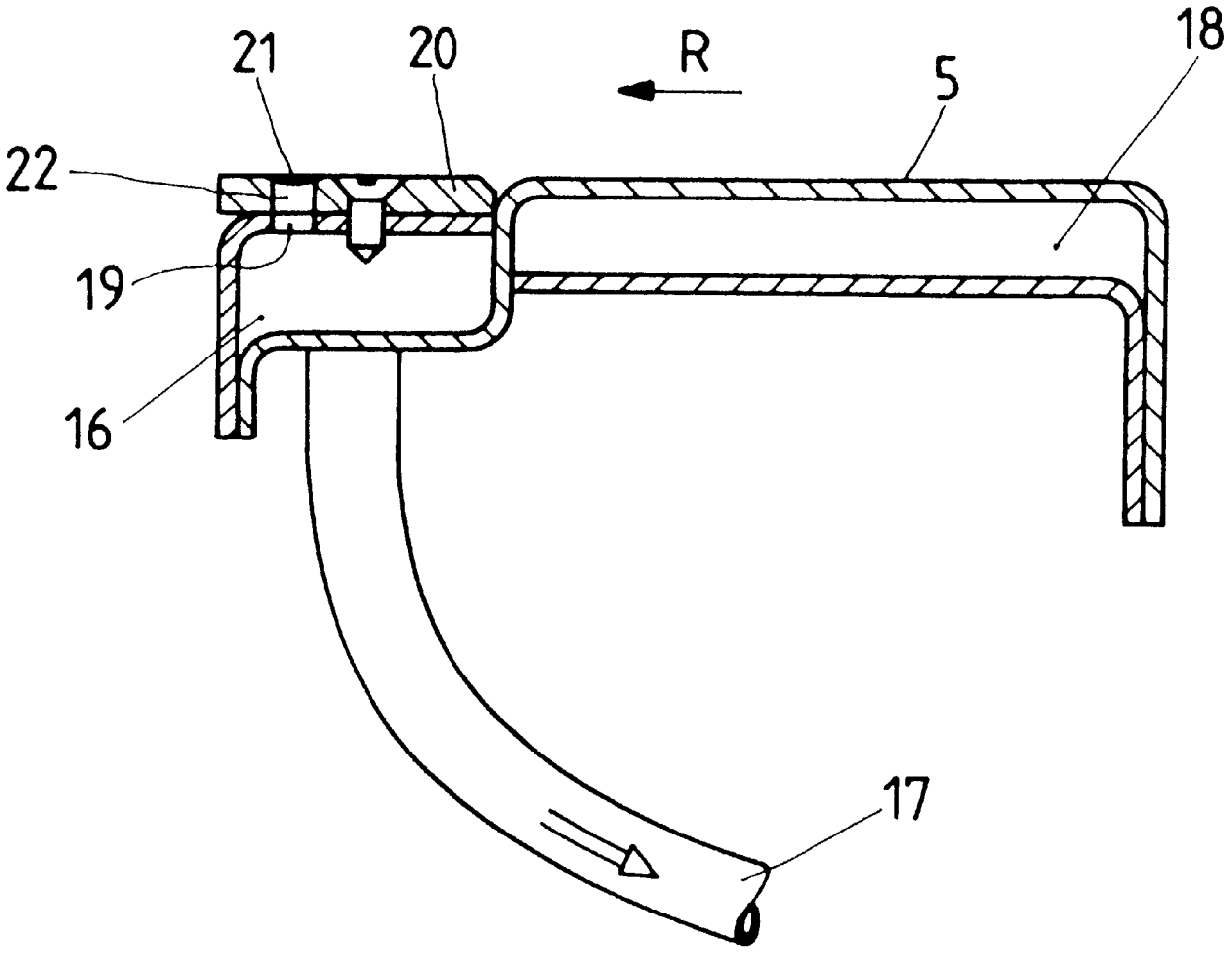
FIG. 6 is a transverse section through the brake of FIG. 1.

FIG. 6 is a larger-scale transverse section through brake 5. Brake 5 preferably includes a box section with a suction chamber 16 on the front. Suction chamber 16 communicates with a suctioning-air supply line 17. The area of brake 5 facing suction chamber 16 accommodates another chamber 18. The top of suction chamber 16 is provided with aerating bores 19, which may be accompanied by an aerating slot. Secured to suction chamber 16 and facing aerating bores 19 is a suction strip 20. The top of suction strip 20 is provided with a shallow groove 21. Groove 21 communicates with aerating bores 19 by way of suction openings 22.

Mounting the rigid suction strip 20 on suction chamber 16 is one of the essential characteristics of brake 5 and is the foundation for its very simple structure.

Figure 7:
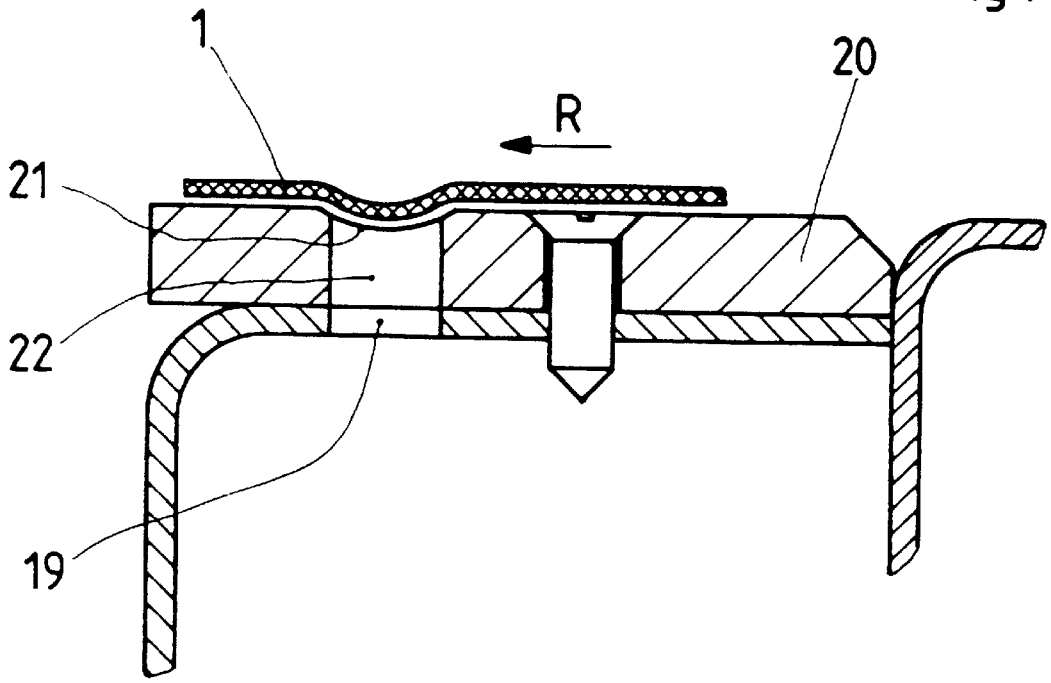
FIG. 7 is a detail of the brake of FIG. 1.
Figure 8:
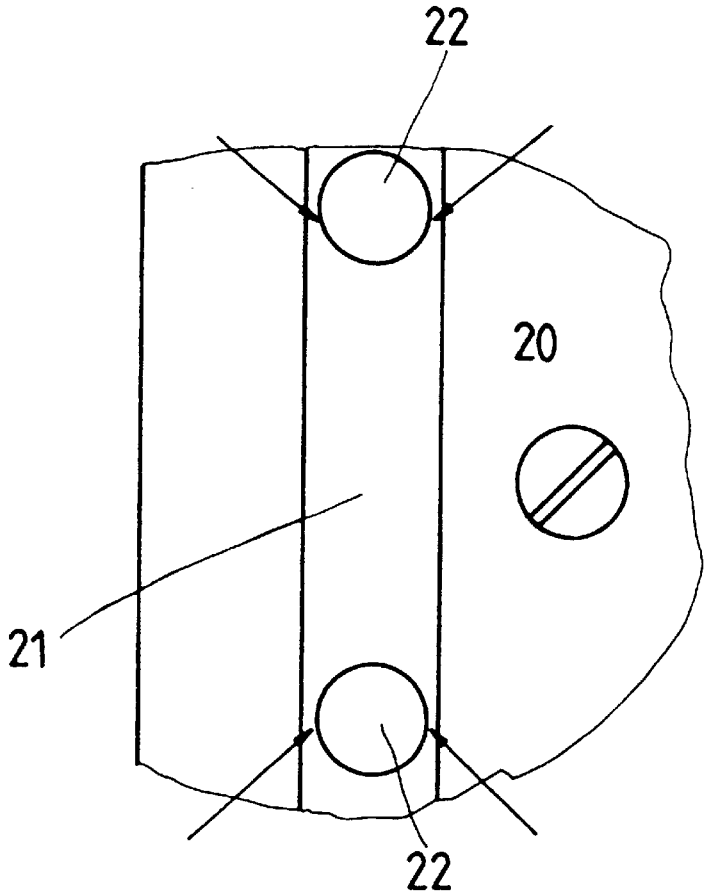
FIG. 8 is a top view of the forward edge of the brake of FIG. 1.

The relationship between suction openings 22 and groove 21 is illustrated in greater detail by FIG. 7. Especially evident is the flatness of the top of suction strip 20 and the transitional contours that ensure smooth sheet travel. It is essential for the diameter of suction openings 22 to be less than a width of groove 21 to ensure that the shallow radius of curvature of the outlet edges of groove 21 remain constant over their total length. The top view of suction strip 20 in FIG. 8 also shows how suction openings 22 are accommodated in groove 21.

The reason for the relationship selected and illustrated between suction openings 22 and groove 21 is, as described above, because any sharp-edged areas at the edge of groove 21 at suction openings 22 extending toward the sheet would damage sheet 1. There is accordingly in the area indicated by the arrow a gap between the edge of suction openings 22 and the outlet edge of groove 21. The distribution of the suction openings 22 along groove 21 is accordingly dependent on and determined by the distribution of the vacuum.

The purpose of the separate suction strip 20 will now be specified. Once the device has been in use for a long time and wears out, the suction strip 20 on brake 5 can easily be replaced with another. There will accordingly be no need to replace or even service brake 5 as a whole.

The functioning of brake 5 will now be specified. A sheet 1 is conveyed from the press to stack 3 by chain-conveyor system 2. Once the sheet has traveled past the gripper system, sheet 1 is captured and guided by sheet capture device 25. The sheet simultaneously travels past brake 5, which drive mechanism 15 raises by way of crank 9 in synchronization with the motion of the sheets, capturing the sheet 1 by sucking it against suction strip 20. The specially arranged distribution of suction openings 22 all the way along brake 5 ensures a uniform vacuum throughout groove 21. This leads to sheet 1 being slightly sucked into the groove as seen in FIG. 7. The result is a slight, fluted deformation over the whole width of the sheet 1. This slight deformation is enough to stabilize the sheet 1 laterally and keep the sheet stretched out while also leading to powerful deceleration due to friction against the sheet. Although the advancing sheet 1 is guided down toward the top of stack 3 by the synchronized downward stroke of brake 5, the sheet is secured with a prescribed force at every instant. As a result, the corners and the rear edge of sheet 1 cannot turn up or be forced upwardly so as to impede the advance of the following sheet.

The illustrated sheet brake 5 is of particular advantage when combined with take-over grippers 23 in the vicinity of the forward edge 24 of take-off stack 3. Such grippers accept a sheet 1 once it has been released from chain-conveyor system 2. Take-over grippers 23 execute a back-and-forth motion along direction R in synchronization with the sheet-feed rate. The grippers 23 accept sheet 1 from chain conveyor system 2 and guide the sheet at a decreasing speed to the top and forward edge 24 of take-off stack 3. Due to the regulated motion of take-over grippers 23, the lay-off of sheet 1 can be more or less uniformly and accurately guided in conjunction with brake 5 and always at constantly defined intervals. The particular advantage of the groove 21 in suction strip 20 will be especially evident in conjunction with take-over grippers 23. Since take-over grippers 23 act on the sheet only at certain points, a sheet, especially a sheet of thin stock, can be distorted as it is drawn over brake 5. The sheet 1 can be squeezed across direction R at its rear edge and become corrugated or folded in that direction. This drawback is eliminated by the stretching action of groove 21. Takeover grippers 23 can accordingly be used with even lightweight stock and at any speed in conjunction with brake 5 without any take-off problems. The function of the brake 5 in coordination with sheet travel will now be explained.

A sheet 1 arriving at chain-conveyor system 2 is captured by sheet-capture device 25 and stretched along the path of travel. Upon arrival of the last third portion of sheet 1, brake 5 will be positioned at its highest point and in possession of the sheet via suction. The sheet will be subjected to suction and guided down in a sinusoidal motion as the sheet 1 advances. The most rapid downward motion will not be attained until the rear edge of sheet 1 has traveled over sheet-capture device 25. This procedure ensures that the downward-traveling brake 5 will not come to rest on sheet-capture device 25 and that sheet 1 will eventually be lifted by brake 5. As it is conveyed farther, sheet 1 will be transferred to take-over gripper 23, which will guide it to the stops at the forward edge of stack 3. Meanwhile, sheet 1 will be lowered farther and farther toward the top of the stack by brake 5 while being laterally stretched by the suction exerted via groove 21. The braking action can be augmented by providing the chamber 18 illustrated in FIG. 6 with vacuum and generating an extra braking surface on its top portion by way of suction openings.

Figure 9:
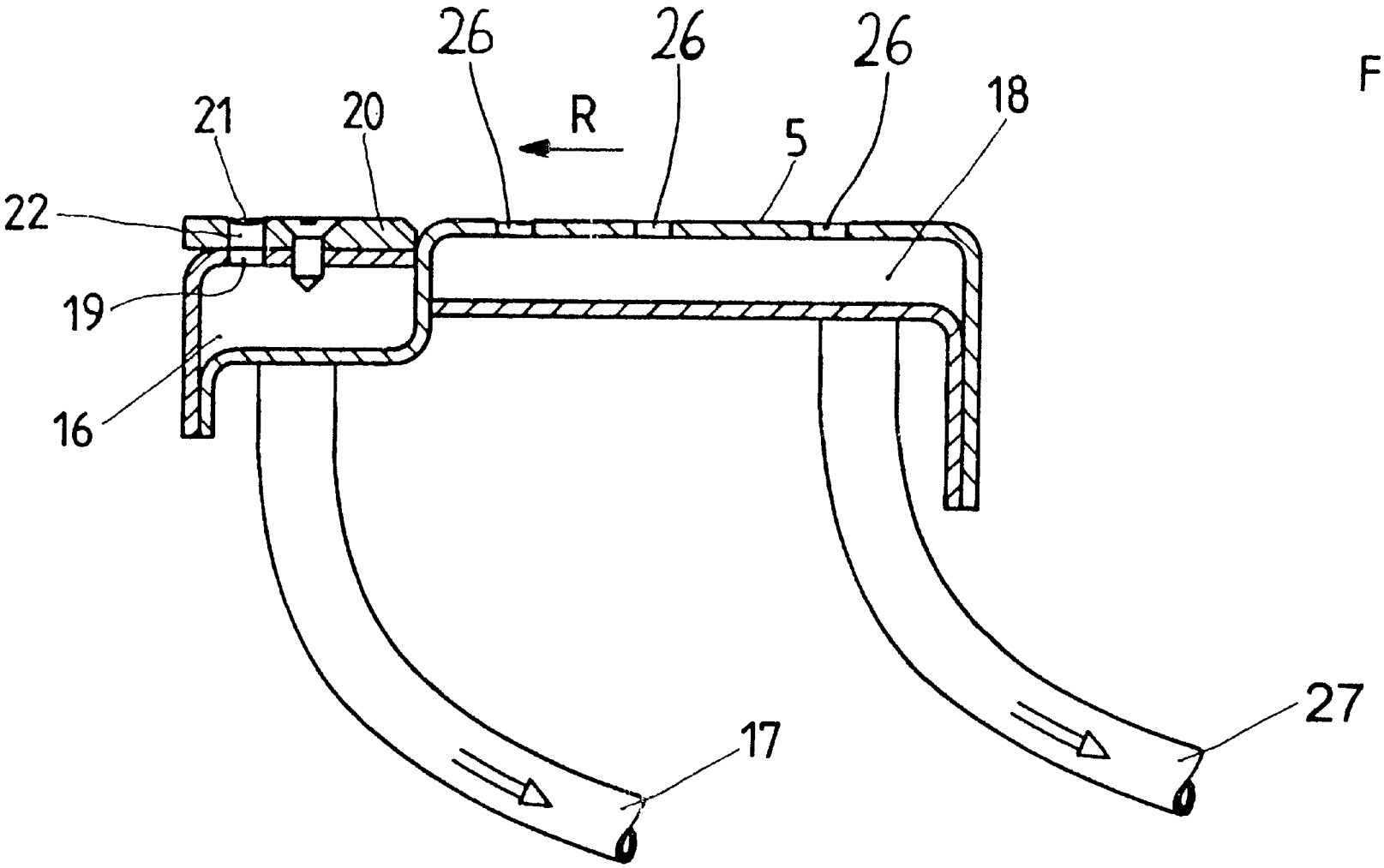
FIG. 9 is a transverse section through another preferred embodiment of the brake of FIG. 1.

FIG. 9 illustrates another preferred embodiment of the present invention. In this preferred embodiment, chamber 18 is also provided with vacuum. For that purpose and in that event, the suction openings 26 illustrated in FIG. 9 are preferably provided at the top of chamber 18. Suction openings 26 act on sheet 1 and increase the holding surface of brake 5. There is also a vacuum-supply line 27 communicating with chamber 18. In this preferred embodiment, the second chamber 18 in brake 5 is used instead of sheet-capture device 25 to forward the sheet to brake 5. The advantage is that nothing detrimental to sheet travel can occur between the sheet-capture device, comprising chamber 18 in this case, and brake 5. Sheet 1 can accordingly not corrugate or execute other motions even in this area. Suctioning-air supply lines 17 and 27 can be separately adjusted. The capture-and-braking action can accordingly be established for various stocks and types of printing.

Reliable sheet braking is attained in the preferred embodiments of FIG. 9 in that brake 5 will be able to effectively secure even sheets of cardboard.

The shape of brake 5 and especially of suction strip 20 in addition to the coordination of their motions ensure accurate and precise guidance of sheets 1 into a precise-edged stack. Alternatives are also possible with respect to the use of a stationary and a stroking brake 5, to their combination with a stationary or stroked sheet-capture device 25, or to their design in the form of a chamber 18. Another essential feature is the synchronization of the strokes with sheet travel and their adaptation to adjustment for different sheet sizes as described above.

While the invention has been particularly shown and described with reference to preferred embodiments thereof, it will be understood by those skilled in the art that the foregoing and other changes in form and details may be made therein without departing from the spirit and scope of the invention.

We claim:

1. An apparatus for laying off sheets in a sheet take-off unit of a printing press comprising:

a brake extending along a width of a take-off stack of sheets for applying a force to seize a bottom of a sheet and laying the seized sheet off onto the stack after decelerating the seized sheet; wherein the brake has at least one suction chamber, one suctioning-air supply line, one rigid suction strip, a groove formed in the rigid suction strip extending along a width of the brake in a direction that is substantially perpendicular to a direction of sheet travel and suction openings provided along and inside of the groove and in communication with the suction chamber, the groove being arranged such that after the sheet is seized by the brake, the sheet is guided while being laterally stretched by being sucked into the groove which causes a fluted deformation along a width of the seized sheet so as to stabilize the sheet.

2. An apparatus as in claim 1 wherein the brake includes a hollow structural section, the suctioning-air supply line communicates with at least one suction chamber in the hollow structural section, and a suction strip is positioned in a vicinity of an edge of the hollow structural section extending along the sheet-travel direction and constitutes a surface of the brake that acts on the sheet being seized.

3. An apparatus as in claim 1 wherein the suction strip is adapted to be detached from the brake and includes suction openings aligned with an aerating bore located in the brake.

4. An apparatus as in claim 1, wherein a diameter of the suction openings is less than a width of the groove.

5. An apparatus as in claim 1 wherein at least one take-over gripper located in the vicinity of a forward edge of the take-off stack to accept the sheet from a chain-conveyor system by seizing a forward edge of the sheet and delivers the sheet to stops located at a forward edge of the stack, a motion of the take-over gripper is synchronized with a motion of the brake.

6. An apparatus as in claim 1 wherein a motion of the brake is regulated such that an end of the sheet upstream in the direction traveled by the sheets is not touched by the sheet-capture device as it moves down toward the take-off stack.

7. An apparatus as in claim 1 wherein the drive mechanism that provides the brake with its stroke has straight guides and a crank drive mounted on the brake to generate a constant up-and-down motion.

8. An apparatus as in claim 7, wherein the crank drive is arranged to be continuously displaced along with the brake along, against, and parallel to the direction traveled by the sheets and parallel to a rear edge of the stack to adjust for various sheet sizes.

9. An apparatus as in claim 8, wherein the crank drive is connected to a synchronized drive mechanism of the printing press by a telescoping articulated shaft.

10. An apparatus for laying off sheets in a sheet take-off unit of a printing press comprising:

a sheet-capture device;

a brake extending along a width of a take-off stack of sheets for applying a force to seize a bottom of a sheet and laying the seized sheet off onto the stack after decelerating the sheet, the brake being located downstream of the sheet-capture device; and a stroke-generating drive mechanism synchronized with a rate of movement of oncoming sheets and arranged to constantly move the brake up and down across a direction traveled by the sheets, the stroke-generating mechanism being regulated to ensure that the brake always acts on the sheets only in an area upstream of a sheet-travel direction; wherein the sheet-capture device is located along the sheet-travel direction and the brake is adapted to move up and down, and includes at least one rigid suction strip located on the brake.

11. An apparatus as in claim 2 wherein the brake includes a hollow structural section, the suctioning-air supply line communicates with at least one suction chamber in the hollow structural section, and a suction strip is positioned in a vicinity of an edge of the hollow structural section extending along the sheet-travel direction and constitutes a surface of the brake that acts on the sheet being seized.

12. An apparatus as in claim 2 wherein the suction strip is adapted to be detached from the brake and includes suction openings aligned with an aerating bore located in the brake.

13. An apparatus as in claim 2 wherein a top of the suction strip has a groove extending and curving away from the sheet being guided.

14. An apparatus as in claim 13, wherein the suction openings are positioned inside the groove and a diameter of the suction openings is less than a width of the groove.

15. An apparatus for laying off sheets in a sheet take-off unit of a printing press comprising:

a sheet-capture device;

a brake extending along a width of a take-off stack of sheets for applying a force to seize a bottom of a sheet and laying the seized sheet off onto the stack; wherein the brake and the sheet-capture device are connected and have a common stroke-generating drive mechanism which is synchronized with a rate of movement of oncoming sheets and is adapted to constantly move the brake up and down across a direction traveled by the sheets, the brake is located downstream of the sheet-capture device, the sheet-capture device is positioned along the sheet-travel direction and includes a suction generating device that generates a stream of suction air and the brake is positioned by at least one rigid suction strip on the brake.

16. An apparatus as in claim 15 wherein the brake includes a hollow structural section, the suctioning-air supply line communicates with at least one suction chamber in the hollow structural section, and a suction strip is positioned in a vicinity of an edge of the hollow structural section extending along the sheet-travel direction and constitutes a surface of the brake that acts on the sheet being seized.

17. An apparatus as in claim 15 wherein the suction strip is adapted to be detached from the brake and includes suction openings aligned with an aerating bore located in the brake.

18. An apparatus as in claim 15 wherein a top of the suction strip has a groove extending and curving away from the sheet being guided.

19. An apparatus as in claim 18, wherein the suction openings are positioned inside the groove and a diameter of the suction openings is less than a width of the groove.

* * * * *